US007317468B2

(12) United States Patent
Struble et al.

(10) Patent No.: US 7,317,468 B2
(45) Date of Patent: Jan. 8, 2008

(54) THERMAL PROCESSOR EMPLOYING DRUM AND FLATBED TECHNOLOGIES

(75) Inventors: Kent R. Struble, Woodbury, MN (US); John M. Nutter, Ramsey, MN (US)

(73) Assignee: Carestream Health, Inc., Rochester, NY (US)

( * ) Notice: Subject to any disclaimer, the term of this patent is extended or adjusted under 35 U.S.C. 154(b) by 305 days.

(21) Appl. No.: 11/029,592

(22) Filed: Jan. 5, 2005

(65) Prior Publication Data

US 2006/0146114 A1 Jul. 6, 2006

(51) Int. Cl.
*B41J 3/32* (2006.01)

(52) U.S. Cl. ..... 347/171

(58) Field of Classification Search ..... 347/171–172, 347/174–177, 213, 215, 220–221, 228; 430/348; 219/216
See application file for complete search history.

(56) References Cited

U.S. PATENT DOCUMENTS

| | | | | |
|---|---|---|---|---|
| 2,896,058 | A | 7/1959 | Perryman | |
| 3,232,226 | A | 2/1966 | Schaum et al. | |
| 3,534,673 | A | 10/1970 | Muller | |
| 3,557,469 | A | 1/1971 | Edgington | |
| 3,629,549 | A | 12/1971 | Svendsen | |
| 3,648,019 | A | 3/1972 | Brewitz | |
| 3,690,015 | A | 9/1972 | Umahashi et al. | |
| 3,709,472 | A | 1/1973 | Kreitz et al. | |
| 3,739,143 | A | 6/1973 | Amundson et al. | |
| 3,774,520 | A | 11/1973 | Smith et al. | |
| 3,807,616 | A | 4/1974 | Hope et al. | |
| 3,900,580 | A | 8/1975 | Dhoble | |
| 3,914,097 | A | 10/1975 | Wurl | |
| 3,991,483 | A | 11/1976 | Knechtel et al. | |
| 4,076,532 | A | 2/1978 | Gottermeier | |
| 4,079,635 | A | 3/1978 | Hope et al. | |
| 4,163,892 | A | 8/1979 | Komatsu et al. | |
| 4,182,611 | A | 1/1980 | Knaak | |
| 4,242,566 | A | 12/1980 | Scribner | |
| 4,322,158 | A | 3/1982 | Frias et al. | |
| 4,358,194 | A | 11/1982 | Krehbiel | |
| 4,485,294 | A * | 11/1984 | Rosenberg | 219/216 |
| 4,518,845 | A | 5/1985 | Svendsen et al. | |
| 4,644,667 | A | 2/1987 | Yanagi et al. | |
| 4,658,716 | A | 4/1987 | Boissevain | |
| 4,739,358 | A | 4/1988 | Takahashi et al. | |
| 4,903,082 | A | 2/1990 | Dyer et al. | |
| 5,352,863 | A | 10/1994 | Svendsen | |

(Continued)

FOREIGN PATENT DOCUMENTS

| | | |
|---|---|---|
| EP | 1 282 009 | 2/2003 |

(Continued)

*Primary Examiner*—K. Feggins

(57) ABSTRACT

A thermal processor for thermally developing an image in an imaging media. The thermal processor includes a drum processor and a flatbed processor. The drum processor forms an arcuate transport path and is configured to move the imaging media along an arcuate transport path. The flatbed processor forms a generally planar transport path and is configured to move the imaging media along a generally planar transport path. The flatbed processor is coupled to the drum processor such that the arcuate transport path and the generally planar transport path together form a processing path through the thermal processor along which the imaging media moves from the drum processor to the flatbed processor during development.

25 Claims, 3 Drawing Sheets

U.S. PATENT DOCUMENTS

| | | | | |
|---|---|---|---|---|
| 5,414,488 | A | 5/1995 | Fujita et al. | |
| 5,420,659 | A | 5/1995 | Manico et al. | |
| 5,463,444 | A | 10/1995 | Watanabe et al. | |
| 5,502,532 | A | 3/1996 | Biesinger et al. | |
| 5,869,806 | A | 2/1999 | Struble et al. | |
| 5,909,232 | A | 6/1999 | Goto et al. | |
| 6,262,756 | B1 * | 7/2001 | Kashino et al. | 347/215 |
| 2002/0048716 | A1 | 4/2002 | Watanabe et al. | |
| 2005/0058954 | A1 * | 3/2005 | Okada | 430/348 |

FOREIGN PATENT DOCUMENTS

| | | |
|---|---|---|
| JP | 2001/330922 | 11/2001 |

* cited by examiner

THERMAL PROCESSOR EMPLOYING DRUM AND FLATBED TECHNOLOGIES

FIELD OF THE INVENTION

The present invention relates generally to an apparatus and method for thermally processing an imaging media, and more specifically to an apparatus and method for thermally developing an imaging media employing drum processor and flatbed processor technologies.

BACKGROUND OF THE INVENTION

Photothermographic film generally comprises a base material, such as a thin polymer or paper, typically coated on one side with an emulsion of heat sensitive materials. Once the film has been subjected to photostimulation, via the laser of a laser imager for example, a thermal processor is employed to develop the resulting latent image through application of heat to the film. In general, a thermal processor raises the base material and emulsion to an optimal development temperature and holds the film at the development temperature for a required time period to develop the image. However, in order to provide optimal and consistent quality in developed images, a thermal processor must perform this heating process smoothly and consistently within a single film and between subsequent films. Additionally, in order to ensure that chemical reactions proceed correctly in the emulsion and to increase film throughput, the thermal processor must accomplish this temperature rise as quickly as possible without causing distortions or wrinkling of the base material.

Two primary types of thermal processors, drum processors and flatbed processors, have been developed by the industry for thermally developing photothermographic film. Drum processors are characterized by a rotating heated drum having a series of pressure rollers positioned around a segment of the drum's surface. During development, the pressure rollers generally hold the emulsion-side of the film in contact with heated drum. However, as some types of photothermographic film are heated, their emulsions produce gaseous byproducts, particularly while the film is at the development temperature. While drum processors heat the film quickly and smoothly, the gaseous byproducts can sometimes be trapped between the film and the drum and condense on the drum's surface. Over time, such contaminants can accumulate on the drum's surface and cause visual artifacts in the developed image. Consequently, drum processors require regular and costly maintenance to clean the accumulated contaminants from the drum.

Also, the drum's size (i.e. diameter) is dependent on the film's development time and the desired throughput of the processor, wherein increasing the processor's throughput while holding the development time constant requires an increase in the drum's size. As a result, the throughput of a drum processor is limited as the required drum size quickly becomes impractical as the throughput is increased.

Flatbed processors are characterized by a series of spaced rollers that convey the photothermographic along a typically horizontal path through a heated oven. One advantage of flatbed processors is that the gaseous byproducts produced by the film during development can be more easily captured and conveyed away from the processor as compared to drum processors. Additionally, flatbed processors generally heat the photothermographic film more slowly than drum processors, enabling the film's base material to expand without wrinkling or distorting. However, the slower rate of heating requires a longer heated path and oven, resulting in the flatbed processor having a larger physical size relative to a drum processor.

Thus, there is a need for an improved thermal processor that reduces the above described problems associated with conventional thermal processors.

SUMMARY OF THE INVENTION

In one embodiment, the present invention provides a thermal processor for thermally developing an image in an imaging media, the thermal processor including a drum processor and a flatbed processor. The drum processor forms an arcuate transport path and is configured to move the imaging media along the arcuate transport path. The flatbed processor forms a generally planar transport path and is configured to move the imaging media along the generally planar transport path. The flatbed processor is coupled to the drum processor such that the arcuate transport path and the generally planar transport path together form a processing path through the thermal processor along which the imaging media moves from the drum processor to the flatbed processor during development.

In one embodiment, the present invention provides a thermal processor for thermally developing an imaging media having a development temperature, the thermal processor including a heated drum assembly and a flatbed processor. The heated drum assembly is configured to receive the imaging media at an ambient temperature and to heat the imaging media to a desired pre-dwell temperature at least equal to the development temperature. The flatbed processor is configured to receive the imaging media from the heated drum assembly substantially at the desired temperature and is configured to maintain the imaging media substantially at the development temperature for a dwell time. In one embodiment, the thermal processor further includes a transfer element positioned between the heated drum assembly and the flatbed processor and configured to direct the imaging media from the heated drum assembly to the flatbed processor upon the imaging media substantially reaching the desired temperature.

By employing a drum processor to initially heat the imaging material, a thermal processor in accordance with the present invention can more quickly heat the imaging media to a desired development temperature as compared to conventional, stand-alone, flatbed processors. Furthermore, by transferring the imaging media from the drum processor to the flatbed processor upon the imaging media substantially reaching development temperature, nearly all of the gaseous byproducts released by the imaging media are released within the flatbed processor. As a result, gaseous byproducts can be more readily removed from the thermal processor as compared to conventional, stand-alone, drum processors. This, in-turn, reduces both costly maintenance associated with cleaning contaminants deposited by the gaseous byproducts and image artifacts resulting from such contaminants.

Additionally, since the drum processor is not required to maintain the film at the development temperature for the required dwell time, but only to heat the imaging media until it reaches development temperature, the drum processor can employ a smaller drum relative to conventional drum processors. Finally, since the flatbed processor is required only to maintain the temperature of the imaging media at the development temperature for the required dwell time and not to heat the imaging media from an ambient temperature, another advantage of the thermal processor is that the flatbed processor does not need the thermal mass or the length required by conventional, stand-alone flatbed processors.

DETAILED DESCRIPTION OF THE INVENTION

Figure 1:
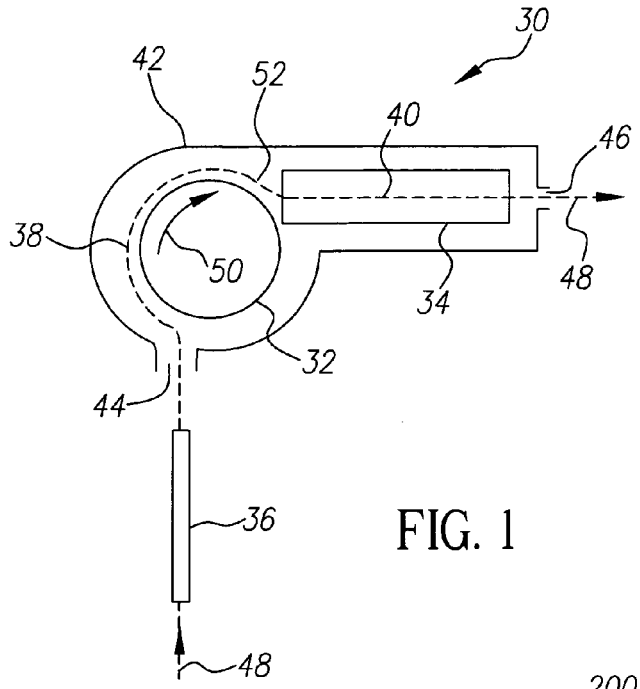
FIG. 1 is a block diagram illustrating generally one exemplary embodiment of a thermal processor according to the present invention.

FIG. 1 is a block diagram illustrating generally one embodiment of a thermal processor 30 including a drum-type processor 32 and a flatbed type processor 34, according to the present invention, for thermally developing an image in an imaging media, such as imaging media 36. Drum processor 32 forms an arcuate transport path 38 and is configured to move imaging media 36 along arcuate path 38. Flatbed processor 34 forms a generally planar transport path 40 and is configured to move imaging media 36 along generally planar transport path 40. In one embodiment, as illustrated, drum processor 32 and flatbed processor 34 are housed within a common enclosure 42 having an entrance region 44 and an exit region 46. Flatbed processor 34 is coupled to drum processor 32 such that arcuate transport path 38 and planar transport path 40 together form a processing path through thermal processor 30 from entrance region 44 to exit region 46.

During development, drum processor 32 receives imaging media 36 at an ambient temperature via entrance region 44. As drum processor 32 rotates as indicated by directional arrow 50, imaging media 36 is moved along arcuate transport path 38 and heated by drum processor 32. Upon reaching a desired pre-dwell temperature at a location 52 along a circumference of drum processor 32, the desired pre-dwell temperature being substantially equal to at least a development temperature associated with imaging, imaging media 36 is transferred from drum processor 32 to flatbed processor 34. Flatbed processor 34 maintains imaging media 36 at a temperature substantially equal to the development temperature for a desired development time, or dwell time, as flatbed processor 34 moves imaging media 36 along generally planar transport path 40 to exit region 46 of thermal processor 30. In one embodiment, as will be described in greater detail below, thermal processor 30 includes a contaminant removal system configured to remove byproducts from drum processor 32 and flatbed processor 34 which are out-gassed from imaging media 36 during thermal development.

Drum processor 32 enables thermal processor 30 according to the present invention to more quickly heat imaging media to a desired development temperature as compared to a conventional flatbed processor. In one embodiment, by transferring the imaging media from drum processor 32 to flatbed processor 34 upon the imaging media 36 substantially reaching the desired development temperature, substantially all of the development of imaging media 36 occurs in flatbed processor 32. In-turn, most of the out-gassing of byproducts and other compounds from imaging media 36 also occurs in flatbed processor 34 where such contaminants can be more readily removed, thereby substantially reducing contaminant build-up in drum processor 32 and, thus, thermal processor 30 as a whole. As a result, costly maintenance associated with cleaning thermal processor 30 is reduced as is the potential for image artifacts caused by contaminant build-up. Additionally, since drum processor 32 is not required to maintain the imaging media 36 at the development temperature for the required dwell time but only to heat the imaging media 36 until it reaches development temperature, drum processor 32 can employ a smaller drum relative to conventional drum processors.

Figure 2:
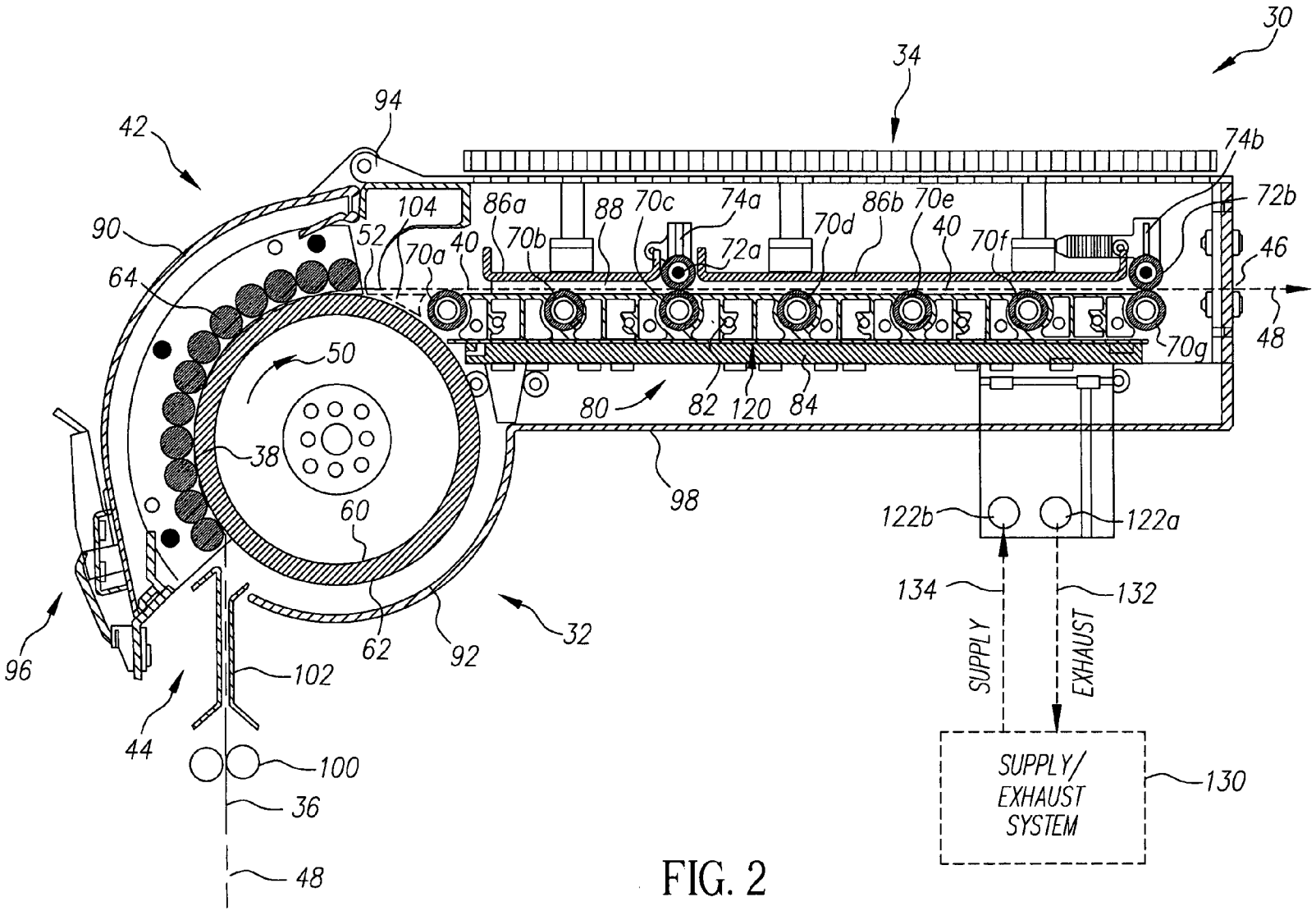
FIG. 2 is a cross-sectional view illustrating one exemplary embodiment of a thermal processor according to the present invention.

FIG. 2 is a cross-sectional view illustrating one exemplary embodiment of thermal processor 30 according to the present invention. Drum processor 32 includes a circumferential heater 60 mounted within an interior of a rotatable processor drum 62, rotatable processor drum 62 being driven so as to rotate in a clockwise direction as indicated by directional arrow 50. A plurality of pressure rollers 64 is circumferentially arrayed about a segment of processor drum 62, such that processor drum 62 and pressure rollers 64 together form the arcuate transport path 38 of overall processing path 48 through thermal processor 30. Pressure rollers 64 are configured to hold imaging media, such as imaging media 36, in contact with processor drum 62 along arcuate path 38 during the development process.

Flatbed processor 34 includes a plurality of rollers 70, illustrated as rollers 70*a* through 70*g*, positioned in a spaced relationship so as to form the generally planar transport path 40 of overall processing path 48 through thermal processor 30. One or more of the rollers 70 are driven such that contact between rollers 70 and imaging media 36 moves imaging media 36 along planar transport path 40. A pair of idler rollers 72 are positioned to form a nip with a corresponding pair of rollers 70 to ensure that imaging media 36 remains in contact with rollers 70 and does not lift from planar transport path 40. In one embodiment, as illustrated, idler rollers 72 are slideably mounted in slots 74 and held in place against corresponding rollers 70 by gravity.

Flatbed processor 34 further includes a heating system 80 comprising a heat plate 82 and a heater 84. In one embodiment, as illustrated, heater 84 comprises a resistive heat blanket. One or more plates 86, illustrated as plates 86*a* and 86*b*, are spaced from and positioned generally in parallel with heat plate 82 so as to form an oven 88 about generally planar transport path 40.

Heat plate 82 and heat blanket 84 can be configured with corresponding multiple zones, with a temperature of each zone individually controlled, for example, using a controller and a temperature sensor (neither of which is shown) corresponding to each zone, such as a resistance temperature device or a thermocouple. Additionally, the zones of heat blanket 84 can be configured with varying watt densities such that one zone may be capable of delivering more thermal energy than another.

In one embodiment, as illustrated, heat plate 82 is formed to partially wrap around rollers 70 so that rollers 70 are partially "nested" within heat plate 82. By partially nesting rollers 70 within heat plate 82 in this fashion, heating system 80 can more effectively maintain the temperature rollers 70 at the development temperature. In one embodiment, as illustrated and as will be discussed in greater detail below, heat plate 82 comprises an extruded aluminum structure including integral air passages forming a portion of a contaminant removal system. In one embodiment, since flatbed processor 34 is required only to maintain the temperature of the imaging media at the development temperature for the required dwell time and not to heat the imaging media from an ambient temperature, heat plate 82 has a thermal mass and length less than that required by conventional, stand-alone flatbed processors.

Thermal processor 30 further includes a common enclosure 42 that houses both drum processor 32 and flatbed processor 34. Enclosure 42 includes an upper curved cover 90 spaced from pressure rollers 64 and a lower curved cover 92 spaced from a lower portion of processor drum 62 that enclose drum processor 32. Upper and lower curved covers 90 and 92 have ends spaced from one another to define entrance region 44. Upper curved cover 90 includes a hinge 94 and latch assembly 96 that enable upper curved cover 90 to be opened to allow access to processing drum 62 and pressure rollers 64. Enclosure 42 further includes a generally rectangular cover 98 enclosing flatbed processor 34. Rectangular cover 98 is coupled at one end to upper and lower curved covers 90 and 92 and includes exit region 46 at an opposite end. A pair of feed rollers 100 and an entrance guide 102 are positioned at entrance region 44.

During operation, circumferential heater 60 heats processor drum 62 to the desired pre-dwell temperature. In one embodiment, the pre-dwell temperature is within a range from 120 to 130° C. In one embodiment, the pre-dwell temperature is at least equal to the development temperature, or dwell temperature, of imaging media 36. In one embodiment, the desired pre-dwell temperature is 125 degrees centigrade (° C.).

Feed rollers 100 receive and feed a piece of exposed imaging media 36 to entrance guide 102 that channels imaging media 36 to processor drum 62. As imaging media 36 contacts processor drum 62, the rotation of processor drum 62 draws exposed imaging media 36 under pressure rollers 64. As imaging media 36 wraps around and is held against processing drum 62 by pressure rollers 64, imaging media 36 begins to be heated to the pre-dwell temperature. Drum processor 32 is configured so that imaging media 36 is heated substantially to the desired pre-dwell temperature upon reaching location 52, which marks an endpoint of arcuate transport path 38.

Upon reaching location 52, imaging media 36 is directed away from processing drum 62 and transitioned to flatbed processor 34. In one embodiment, as illustrated, a last pressure roller of the plurality of pressure rollers 64 is positioned along the circumference of processor drum 62 proximate to location 52 and processor drum 62 is positioned relative to flatbed processor 34 such that upon reaching location 52, an elasticity of imaging media 36 causes imaging media 36 to separate from processor drum 62 and the continued rotation of processor drum 62 directs imaging media 36 onto generally planar transport path 40 of flatbed processor 34. In an alternate embodiment, a lift mechanism 104, all illustrated by the dashed lines, separates imaging media 36 from processor drum 62 at location 52 and directs imaging media 36 to flatbed processor 34.

The size (i.e., diameter) of processor drum 62, and thus the location 52 along the circumference of processor drum 62 at which imaging media 36 reaches the desired pre-dwell temperature, is dependent on several factors including: the amount of time required to heat imaging media 36 from the ambient temperature to the desired pre-dwell temperature; the desired throughput of thermal processor 30; and it is desirable for several reasons (e.g. complexity of the routing of the transport path) that a wrap angle of imaging media 36 around processor drum 62 should not exceed about 180 degrees. In one embodiment, drum processor 32 heats imaging media 36 from an ambient temperature to a desired pre-dwell temperature in time ranging approximately between 1.5 to 5 seconds. In a preferred embodiment, drum processor 32 heats imaging media 36 from an ambient temperature to a desired pre-dwell temperature of 125° C. in approximately 3.5 seconds. In one embodiment, processor drum 62 has a diameter of 4-inches. In one embodiment, processor drum 62 has a diameter ranging from about 1.5 inches to about 8 inches.

Upon entering flatbed processor 34, rollers 70 move imaging media 36 along generally planar transport path 40 through oven 88 where it is maintained at the desired development temperature, or dwell temperature for a desired time period, or dwell time. In one embodiment, the desired development temperature is within a temperature range from about 110 to about 130° C. In one embodiment, the desired development temperature is substantially equal to about 125° C. In one embodiment, the dwell time is within a time range from about 8 to about 15 seconds. In one embodiment, the dwell time is substantially equal to about 9.5 seconds.

In a preferred embodiment, thermal processor 30 has a 13 second processing cycle, wherein drum processor 32 heats imaging media 36 from an ambient temperature to substantially a desired dwell temperature of 125° C. in 3.5 seconds and flatbed processor 34 maintains imaging media 36 substantially at a desired development temperature of 125° C. for a dwell time of approximately 9.5 seconds. In one embodiment, processing drum 62 and rollers 70 are driven such that the transport speed of imaging media 36 along arcuate path 38 substantially matches transport speed along generally planar transport path 40. In a preferred embodiment, the processing drum 62 and rollers 70 are driven such that the transport speed along processing path 48 is substantially equal to 1.2 inches per second. As such, where the desired dwell time is 9.5 seconds, generally planar transport path 40 of flatbed processor 34 has a length approximately equal to 11.4 inches. Similarly, where drum processor 32 has a 4 inch diameter and is configured to heat imaging media 36 to the desired pre-dwell temperature in 3.5 seconds, arcuate transport path 38 will have a length of approximately 4.2 inches and form a wrap angle of approximately 120 degrees about processor drum 62.

As described earlier, photothermographic film, such as imaging media 36, generally comprises a base material typically coated on one side with an emulsion of heat sensitive materials. To ensure more consistent and even heating of the emulsion, imaging media 36 is transported through thermal processor 30 with its emulsion-side in contact with processor drum 62 and rollers 70. As also described earlier, as imaging media 36 is heated, the emulsion produces gasesous byproducts that can contaminate interior components of thermal processor 30 and cause artifacts in developed images. Most of these gaseous byproducts are released after imaging media 36 reaches development temperature and, thus, are released when imaging media 36 is traveling through flatbed processor 34.

Figure 3:
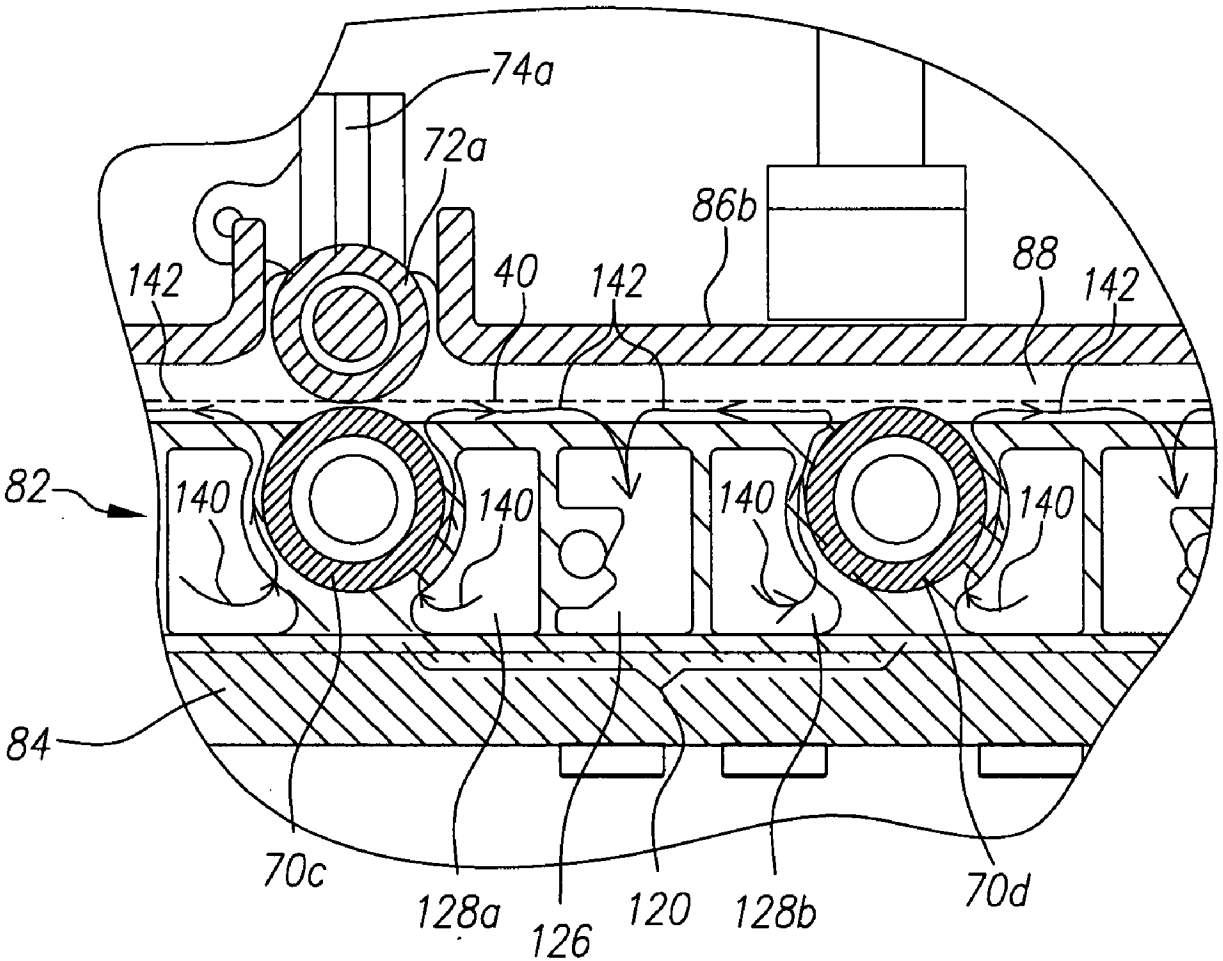
FIG. 3 is an enlarged cross-section view illustrating in greater detail a portion of the thermal processor illustrated by FIG. 2.

In one embodiment, heat plate 82 includes a set of internal passages 120 positioned between each pair of nested rollers 70. Internal passages 120 are coupled to a pair of ports 122*a* and 122*b* and comprise part of a ventilation system adapted to couple to an external supply/exhaust system 130 and configured to remove gaseous byproducts released by imaging media 36 during thermal development. FIG. 3 is a cross-sectional view of a portion of the flatbed processor 34 of FIG. 2 and illustrates in greater detail one set internal passages 120 of heat plate 82. In one embodiment, as illustrated, each set of internal passages 120 includes an exhaust air passage 126 and a pair of make-up air passages 128, illustrated at 128*a* and 128*b*.

Supply/exhaust system 130 is coupled to exhaust air passages 126 via port 122*a* and a link 132 and to make-up air passages 128 via port 122*b* and a link 134. Supply/exhaust system 130 is configured supply and make-up air through link 134 and port 122*b* to make-up air passages 128. The make-up air is circulated through make-up air passages 128 so that it is heated substantially to the development temperature, at which point the heated make-up air is transferred through openings (not shown) in the walls of make-up air passages 128 to rollers 70, as indicated by make-up air flows 140.

Supply/exhaust system 130 creates a vacuum which draws exhaust air from around rollers 70, through oven 88, and into exhaust air passages 126 via openings (not shown) in air passages 126 below transport path 40, as indicated by exhaust air flow 142. The exhaust air, along with contaminants released by imaging media 36 as it moves along transport path 40, is removed from exhaust air passages 126, and thus from thermal processor 30, via port 122*a* and link 132.

A system similar to that described above for removing contaminants from thermal processor 30 is described in U.S. Pat. No. 5,895,592 to Struble, et al., assigned to the same assignee as the present invention, which is herein incorporated by reference. In one embodiment, thermal processor 30 is adapted to enable supply/exhaust system 130 to exhaust air from drum processor 32 as well, particularly in the area where imaging media 36 transitions from drum processor 32 to flatbed processor 34.

Figure 4:
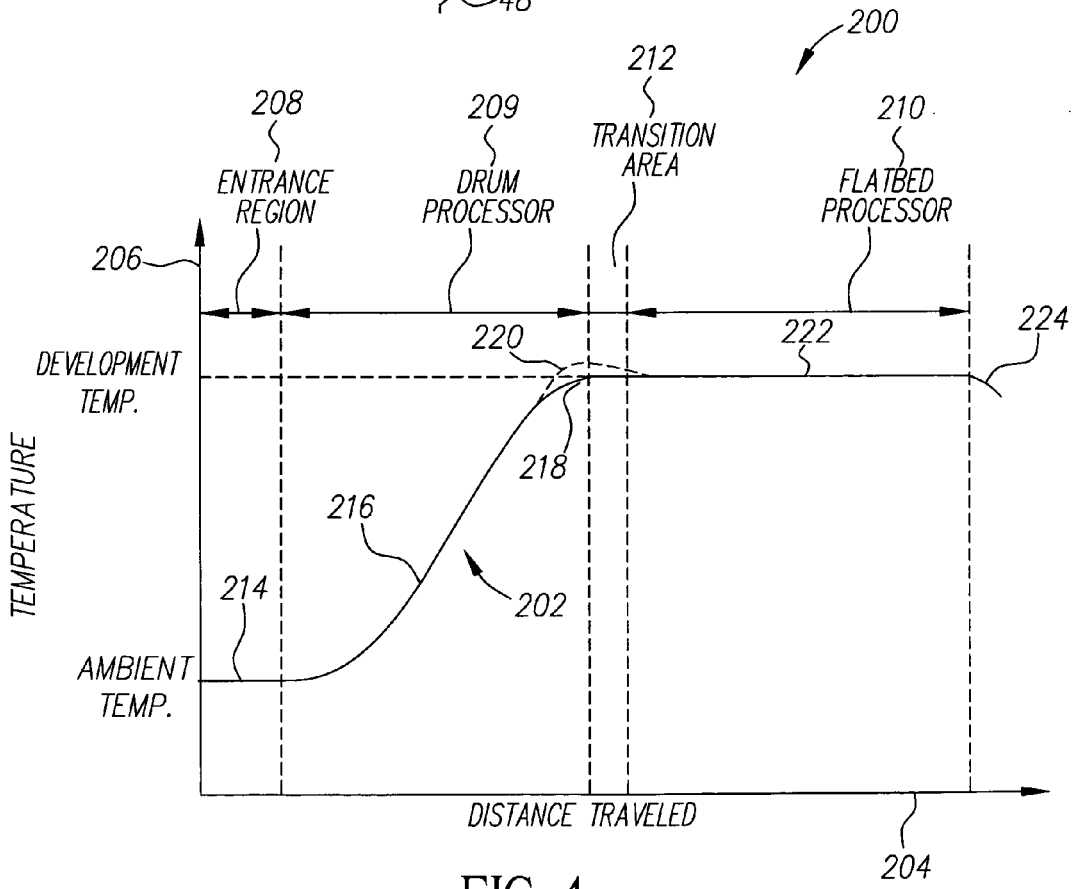
FIG. 4 is a graph illustrating the temperature of a suitable photothermographic film during processing by thermal processor of FIG. 2.

FIG. 4 is a graph 200 illustrating a temperature curve 202 of a suitable photothermographic film as it travels through and is processed by thermal processor 30 as illustrated by FIG. 2. Distance traveled through thermal processor 30 is illustrated along the x-axis, as illustrated at 204, and temperature is illustrated along the y-axis, as illustrated at 206. Graph 200 includes zones representative of different sections of thermal processor 30, with a zone 208 representative of an entrance region of drum processor 32, a zone 209 representative of drum processor 32, a zone 210 representative of flatbed processor 34, and a zone 212 representative of the transition area between drum processor 32 and flatbed processor 34, including, in one embodiment, lift element 104.

As imaging media 36 enters drum processor 32 via feed rollers 100 and entrance guide 102, it is at an ambient temperature level as indicated at 214. After entering drum processor 32, the temperature of imaging media 36 begins to rise, as indicated at 216, until the temperature of imaging media 36 reaches the desired pre-dwell temperature as indicated at 218. As illustrated by graph 200, the desired pre-dwell temperature is substantially equal to the development temperature. In alternate embodiments, the desired pre-dwell temperature is an incremental amount greater than the development temperature, as indicated by the dashed portion 220 of temperature curve 202

In transition areas 212, imaging media 36 separates from drum processor 32, such as at location 52 and/or via lift mechanism 104, and transitions to flatbed processor 34. As indicated at 222, the temperature of imaging media 36 is maintained at the development temperature as it moves along processing path 48 through flatbed processor 34, until exiting flatbed processor 34 as indicated at 224.

In summary, by employing drum processor 32 to initially heat the imaging media 36, thermal processor 30 according to the present invention is able to more quickly heat the imaging media 36 to a desired development temperature as compared to conventional, stand-alone, flatbed processors. Furthermore, by transferring the imaging media 36 from drum processor 32 to flatbed processor 34 upon the imaging media 36 substantially reaching development temperature, nearly all of the gaseous byproducts released by the imaging media 36 are released within flatbed processor 34. As a result, gaseous byproducts can more readily removed from thermal processor 30 as compared to conventional, stand-alone, drum processors. This, in-turn, reduces both costly maintenance associated with cleaning contaminants deposited by the gaseous byproducts and image artifacts resulting from such contaminants.

Additionally, since drum processor 32 is not required to maintain the film at the development temperature for the required dwell time, but only to heat the imaging media 36 until it reaches development temperature, drum processor 32 can employ a smaller drum relative to conventional drum processors. Finally, since flatbed processor 34 is required only to maintain the temperature of the imaging media 36 at the development temperature for the required dwell time and not to heat the imaging media 36 from an ambient temperature, another advantage of thermal processor 30 is that flatbed processor 34 does not need the thermal mass or the length required by conventional, stand-alone flatbed processors.

All documents, patents, journal articles and other materials cited in the present application are hereby incorporated by reference.

The invention has been described in detail with particular reference to certain preferred embodiments thereof, but it will be understood that variations and modifications can be effected within the spirit and scope of the invention.

PARTS LIST

30 Thermal Processor
32 Drum Processor
34 Flatbed Processor
36 Imaging Media
38 Arcuate Transport Path
40 Generally Planar Transport Path
42 Enclosure
44 Entrance Region
46 Exit Region
48 Processor Path
50 Rotational Arrow
52 Location Along Arcuate Path
60 Circumferential Heater
62 Processor Drum
64 Pressure Rollers
70 Rollers
72 Idler Rollers
74 Mounting Slots
80 Heating System
82 Heat Plate
84 Heat Blanket
86 Oven Plates
88 Oven
90 Upper Curved Cover
92 Lower Curved Cover
94 Hinge
96 Latch Assembly
98 Rectangular Cover
100 Feed Rollers
102 Entrance Guide

104 Lift Element
120 Set of Internal Air Passages
122*a*, 122*b* Ventilation Ports
126 Exhaust Air Passage
128*a*, 128*b* Make-Up Air Passages
130 Supply/Exhaust System—External
132 Exhaust Air Link
134 Make-Up Air Link
140 Make-Up Air Flow
142 Exhaust Air Flow
200 Graph
202 Temperature Curve
204 x-axis
206 y-axis

What is claimed is:

1. A thermal processor for thermally developing an image in an imaging media having a development temperature, the thermal processor comprising:

a drum processor forming an arcuate transport path and configured to move the imaging media along the arcuate transport path; and also configured to receive the imaging media at an ambient temperature and to heat the imaging media to a desired pre-dwell temperature; and a flatbed processor forming a generally planar transport path, configured to receive the imaging media from the drum processor substantially at the desired pre-dwell temperature, configured to move the imaging media along the generally planar transport path, the flatbed processor being coupled to the drum processor such that the arcuate transport path and generally planar transport path together form a processing path through the thermal processor along which the imaging media moves from the drum processor to the flatbed processor during development, the flatbed processor including a heater configured to maintain the imaging media substantially at the development temperature for substantially an entire length of a heated portion of the heater.

2. The thermal processor of claim 1, wherein the drum processor and flatbed processor are housed within a common enclosure.

3. The thermal processor of claim 1, wherein the drum processor comprises:

a rotating heated processor drum; and a plurality of pressure rollers spaced circumferentially along a segment of a surface of the processor drum such that the surface of the drum and pressure rollers together form the arcuate transport path, the plurality of pressure rollers configured to hold the imaging media in contact with the surface of the drum, wherein the flatbed processor is positioned relative to the processor drum such that after passing a last pressure roller of the plurality of pressure rollers along the arcuate path the imaging media separates from the surface of the processor drum and transitions to the generally planar transport path.

4. The thermal processor of claim 1, further comprising a transition element positioned between the drum processor and the flatbed processor configured to redirect the imaging material from the arcuate transport path to the generally planar transport path.

5. The thermal processor of claim 1, wherein the drum processor comprises a heated drum having a diameter in a range from 1.5 inches to 8 inches.

6. The thermal processor of claim 1, wherein the drum processor comprises a heated drum having a diameter of 4 inches.

7. The thermal processor of claim 1, wherein the flatbed processor moves the imaging media along the generally planar transport path at a rate substantially equal to a rate at which the drum processor moves the imaging media along the arcuate transport path.

8. A system for thermally developing an image in an imaging media, comprising:

a first processor configured to move the imaging media along a first transport path;

a second processor configured to move the imaging media along a second transport path such that the imaging media moves from the processor to the second processor during development; and a ventilation system adapted to couple to an external supply and exhaust system and configured to remove contaminants released by the imaging media during thermal development.

9. A thermal processor for thermally developing an imaging media having a development temperature, the thermal processor comprising:

a drum processor configured to receive the imaging media at an ambient temperature and to heat the imaging media to a desired pre-dwell temperature; and a flatbed processor configured to receive the imaging media from the heated drum assembly substantially at the desired pre-dwell temperature, the flatbed processor including a heater configured to maintain the imaging media substantially at the development temperature for substantially an entire length of a heated portion of the heater.

10. The thermal processor of claim 9, wherein the desired pre-dwell temperature is at least equal to the development temperature.

11. The thermal processor of claim 9, wherein the desired pre-dwell temperature is above the development temperature.

12. The thermal processor of claim 9, wherein the development temperature is in a range from 120 to 130 degrees centigrade.

13. The thermal processor of claim 9, wherein the development temperature is substantially equal to 125 degrees centigrade.

14. The thermal processor of claim 9, wherein the drum processor comprises a rotating heated processor drum and a plurality of pressure rollers spaced circumferentially along a segment of a surface of the processor drum such that the surface of the drum and pressure rollers together form the arcuate transport path, the plurality of pressure rollers configured to hold the imaging media in contact with the surface of the drum and positioned such that the imaging media releases from contact with the surface of the drum upon the imaging media substantially reaching the desired pre-dwell temperature.

15. The thermal processor of claim 9, further including a transfer element positioned between the drum processor and the flatbed processor and positioned relative to the drum processor so as to direct the imaging media from the drum processor to the flatbed processor upon the imaging media substantially reaching the desired temperature.

16. The thermal processor of claim 9, the heater having a first heat zone and a second heat zone, the first heat zone configured to deliver a different amount of thermal energy than the second heat zone.

17. The thermal processor of claim 9, further including a heat plate and a plurality of rollers at least partially nested within the heat plate.

18. The thermal processor of claim 17, the heat plate defining a plurality of integral air passages, the plurality of air passages forming a portion of a containment removal system.

19. The thermal processor of claim 9, the flatbed processor being configured to maintain the imaging media substantially at the development temperature for a dwell time between approximately 8 seconds and approximately 15 seconds.

20. The thermal processor of claim 9, further including an oven, the oven comprising a plurality of plates positioned generally in parallel with a heat plate.

21. A method of thermally developing a photothermographic imaging media having a development temperature, the method comprising:

receiving the imaging media at an ambient temperature;

heating the imaging media from said ambient temperature to a pre-dwell temperature with a drum processor; and maintaining the imaging media at the development temperature with a heater of a flatbed processor, the heater configured to maintain the imaging media substantially at the development temperature for substantially an entire length of a heated portion of the heater.

22. The method of claim 21, wherein heating the imaging media to a pre-dwell temperature comprises heating the imaging media to a temperature greater than the dwell temperature.

23. The method of claim 21, further comprising:

transferring the imaging media from the drum processor to the flatbed processor upon the imaging media substantially reaching the pre-dwell temperature.

24. The method of claim 16, further comprising removing gaseous byproducts released by the imaging media during thermal development from the drum processor and from the flatbed processor.

25. A method of thermally developing an imaging media having a development temperature, the method comprising:

receiving the imaging media at an ambient temperature;

heating the imaging media to a pre-dwell temperature with a first processor; and maintaining the imaging media at the development temperature with a heater of a second processor, the heater configured to maintain the imaging media substantially at the development temperature for substantially an entire length of a heated portion of the heater;

wherein the pre-dwell temperature is at least equal to the development temperature.

* * * * *